US008657584B2

(12) United States Patent
Shelley et al.

(10) Patent No.: US 8,657,584 B2
(45) Date of Patent: Feb. 25, 2014

(54) APPARATUS AND METHOD FOR TUNING PUMP SPEED

(75) Inventors: Gerald Robin Shelley, Uckfield (GB); Mark Kollin Romeo, North Plains, OR (US); Jeffrey Robert Schwab, Beaverton, OR (US)

(73) Assignee: Edwards Limited, West Sussex (GB)

( * ) Notice: Subject to any disclaimer, the term of this patent is extended or adjusted under 35 U.S.C. 154(b) by 860 days.

(21) Appl. No.: 12/706,167

(22) Filed: Feb. 16, 2010

(65) Prior Publication Data

US 2011/0200450 A1 Aug. 18, 2011

(51) Int. Cl.

| | |
|---|---|
| ***F04B 49/20*** | (2006.01) |
| ***F04B 49/08*** | (2006.01) |
| *F04B 37/14* | (2006.01) |

(52) U.S. Cl.

CPC ..... *F04B 49/20* (2013.01); *F04B 49/08* (2013.01); *F04B 37/14* (2013.01); *F04B 2201/1201* (2013.01); *F04B 2207/02* (2013.01)

USPC ..... 417/42; 73/1.34; 73/1.35; 417/1; 417/279

(58) Field of Classification Search

CPC ..... F04B 37/14; F04B 49/103; F04B 2201/1201; F04B 2207/12

USPC ..... 73/1.34–1.35; 417/1, 27, 42, 44.1, 279, 417/326

See application file for complete search history.

(56) References Cited

U.S. PATENT DOCUMENTS

| | | | | |
|---|---|---|---|---|
| 4,076,458 | A | 2/1978 | Jones | |
| 4,487,058 | A * | 12/1984 | Mennenga | 73/40.7 |
| 5,044,888 | A | 9/1991 | Hester, II | |
| 6,032,544 | A | 3/2000 | Harwell et al. | |
| 6,901,659 | B1 * | 6/2005 | Mishima | 29/846 |
| 6,916,397 | B2 * | 7/2005 | Pfeiffer et al. | 156/345.26 |
| 7,248,975 | B2 | 7/2007 | Lim et al. | |
| 7,353,687 | B2 * | 4/2008 | Tang et al. | 73/1.16 |
| 7,438,534 | B2 | 10/2008 | Holland et al. | |
| 7,645,307 | B2 | 1/2010 | Sun et al. | |
| 2003/0021673 | A1 | 1/2003 | Maejima et al. | |
| 2004/0013531 | A1 | 1/2004 | Curry et al. | |
| 2004/0064291 | A1 | 4/2004 | Samata et al. | |
| 2006/0123737 | A1 | 6/2006 | Higer | |
| 2006/0143895 | A1 * | 7/2006 | Liu et al. | 29/527.1 |
| 2006/0196245 | A1 * | 9/2006 | Liu et al. | 73/1.06 |
| 2010/0268333 | A1 | 10/2010 | Gohean et al. | |

FOREIGN PATENT DOCUMENTS

| | | | | |
|---|---|---|---|---|
| JP | 01024320 A * | 1/1989 | | 118/692 |

OTHER PUBLICATIONS

IPRP for PCT/US2011/022461, report isued Aug. 21, 2012.*

* cited by examiner

*Primary Examiner* — Thomas P Noland

(74) *Attorney, Agent, or Firm* — Westman, Champlin & Koehler, P.A.

(57) ABSTRACT

An apparatus for tuning pump speed at an optimal or desired speed using an automated method is disclosed. The apparatus includes a vacuum pump connected to a chamber for evacuating gas from the chamber. A sensor measures one or more characteristics, such as pressure, of the gas in the chamber. The measured characteristic is compared to a predetermined value. The speed of vacuum pump is adjusted based on the comparison until it falls in a desired range.

9 Claims, 2 Drawing Sheets

APPARATUS AND METHOD FOR TUNING PUMP SPEED

BACKGROUND OF THE INVENTION

The present invention relates generally to an apparatus and method for tuning a rotational speed of vacuum pump using an automated control scheme.

A vacuum pump is a device for evacuating gas from an enclosed space in order to create a low pressure environment within the space. It is often used in a semiconductor manufacturing process. For example, one or more vacuum pumps can be used to evacuate the gas in a process chamber during a chemical vapor deposition (CVD) process. As another example, the vacuum pump can be used to create a low pressure environment in a load lock chamber interfacing between a process chamber and ambient environment. Examples of vacuum pumps categorized by their functions in a semiconductor manufacturing process include, without limitation, booster pumps, load lock pumps, and backing pumps.

Conventionally, a vacuum pump is often over specified to accommodate many variables for different applications, in order to provide a certain assurance of performance. Semiconductor fabrication plants have various pipe work geometries and manufacturing equipment tolerances. An over-specified vacuum pump can easily accommodate different installation requirements in various semiconductor fabrication plants, and still guarantee certain satisfaction of minimum performance.

Although over-specification enables vacuum pumps to accommodate various installation requirements, it has the drawback of inefficiency in energy consumption. An over-specified vacuum pump tends to operate at a rotational speed higher than an optimal level. As a result, it tends to consume more energy than what is needed for an acceptable performance.

Conventionally, manual adjustment of pump speed during operation has been attempted in order to conserve energy. However, such method is crude and inaccurate. It may not be able to provide the accuracy level needed for a vacuum pump to operate at an optimal speed. Furthermore, manual adjustment is inconsistent and prone to errors. This may cause undesired process variations.

BRIEF SUMMARY OF THE INVENTION

The present invention is directed to an apparatus and method for tuning a rotational speed of vacuum pump using an automated control scheme. In some embodiments of the invention, the apparatus includes a vacuum pump connected to a chamber for evacuating gas from the chamber; a sensor coupled to the chamber for measuring a characteristic of the gas in the chamber; and a controller coupled to the sensor and the vacuum pump for adjusting a speed of the vacuum pump in response to a signal generated by the sensor, indicating the measured characteristic of the gas in the chamber.

In some other embodiments of the invention, the method includes steps of setting the vacuum pump at a first speed; measuring a characteristic of a gas in the chamber; comparing the measured characteristic to a predetermined value; and adjusting the speed of the vacuum pump based on the comparison between the measured characteristic and the predetermined value.

The construction and method of operation of the invention, however, together with additional objectives and advantages thereof will be best understood from the following description of specific embodiments when read in connection with the accompanying drawings.

DETAILED DESCRIPTION OF THE INVENTION

Figure 1:
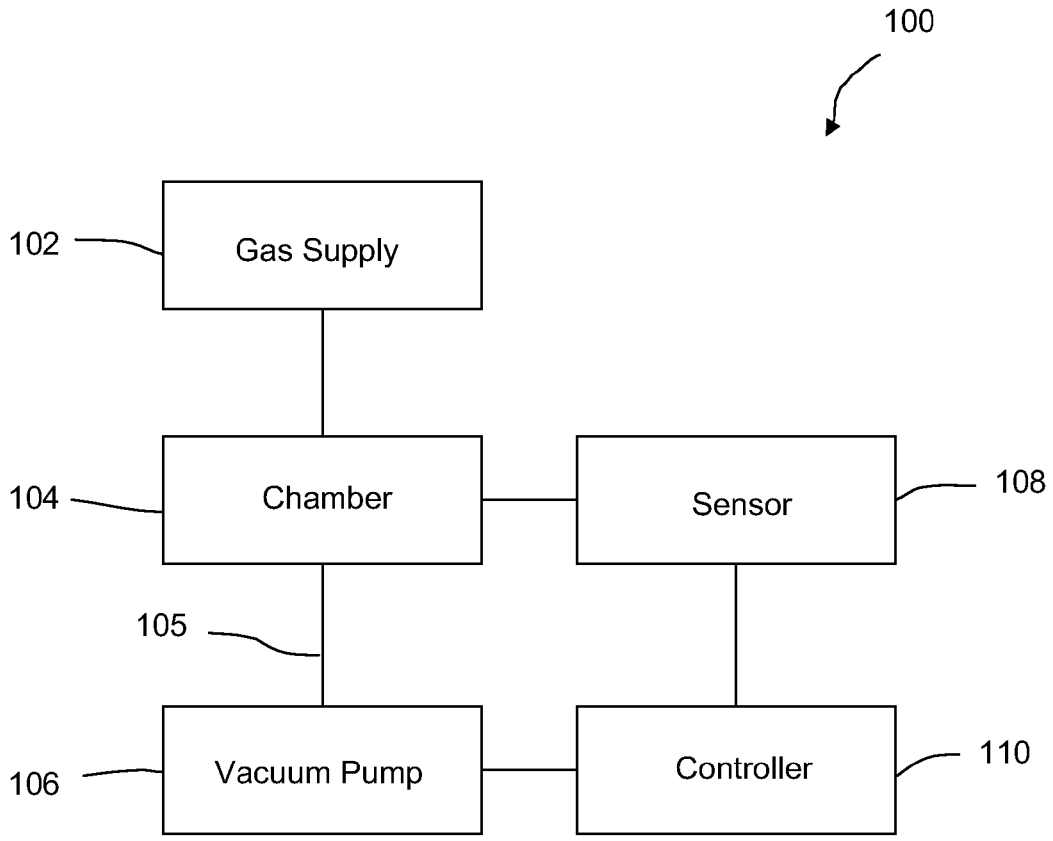
FIG. 1 illustrates a block diagram of an apparatus for tuning pump speed in accordance with some embodiments of the invention.

FIG. 1 illustrates a block diagram of an exemplary apparatus 100 for tuning pump speed in accordance with some embodiments of the invention. The apparatus 100 includes, without limitation, a gas supply 102, chamber 104, vacuum pump 106, sensor 108, and controller 110. The chamber 104 can be a process chamber that receives chemical reactants and other gases from the gas supply 102. The chemical reactants are usually supplied to the chamber 104 in a gaseous state, and can be evacuated from the chamber 104 by the vacuum pump 106 via a fore line 105 connecting in between. The vacuum pump 106 creates a low pressure or partially vacuum environment in the chamber 104.

In some embodiments of the invention, the chamber 104 is a process chamber in which the chemical reactants can form a thin layer of coating on a semiconductor wafer. In some other embodiments of the invention, the chamber 104 can be a load lock chamber with or without a gas supply attached to it. A load lock chamber interfaces between a process chamber and ambient environment for facilitating movements of semiconductor wafers in and out of the process chamber.

In some embodiments of the invention, the vacuum pump 106 categorized by its function can be a booster pump, load lock pump or backing pump. As categorized by its design, the vacuum pump 106 can be a roots pump, roots-claws pump, screw pump, rotary-vane pump, piston pump, liquid ring pump or turbomolecular pump.

The sensor 108 is coupled to the chamber 104 for sensing and measuring one or more characteristics of the gas in the chamber 104. For example, the sensor 108 can be a pressure gauge that senses and measures the pressure of the gaseous chemical reactants or other gases in the chamber 104. As another example, the sensor 108 can be a temperature gauge that senses and measures the temperature of the gaseous chemical reactants or other gases in the chamber 104. In some other embodiments of the invention, the sensor 108 can sense and measure a vibration frequency of the chamber 108, fore line 105 or vacuum pump 106. In some other embodiments of the invention, the sensor 108 can sense and measure a gas flow rate for a gas going through the chamber 108, fore line 105 or vacuum pump 106. It is noted that the examples listed here are not exhaustive, and it is understood that other sensors capable of sensing and measuring any other characteristics of the gas in the chamber 104 or other physical components are within the scope of the invention.

The controller 110 is coupled between the sensor 108 and the vacuum pump 106 for controlling the vacuum pump 106 to adjust its rotational speed in response to a signal generated by the sensor 108, indicating one or more measured characteristics of the gaseous chemical reactants or other gases in the chamber 104. The controller 110 compares the measured characteristics with a predetermined value, and adjusts the rotational speed of the vacuum pump 106 based on the comparison. For example, in the case where the sensor 108 is a pressure gauge, the controller 110 compares the measured pressure of the gas in the chamber 104 with a predetermined value representing an optimal or desired pressure level. The controller 110 controls the vacuum pump 106 to reduce its rotational speed, when the measured pressure is lower than the predetermined value until the speed falls in an acceptable range around the predetermined value. On the other hand, the controller 110 controls the vacuum pump 106 to increase its rotational speed, when the measured pressure is higher than the predetermined value until the speed falls in an acceptable range around the predetermined value.

In some embodiments of the invention, a decrement in pump speed can be set greater than an increment in pump speed. For example, the decrement can be set about five times the increment. As such, a down adjustment of energy consumption can occur faster than an up adjustment.

In some embodiments of the invention, the measured characteristic can be a vibration frequency of the chamber 104, fore line 105 or vacuum pump 106, and the predetermined value can be an optimal or desired vibration frequency in certain conditions where resonance in the vacuum pump 106, fore line 105 and chamber 104 is to be avoided. In such case, the sensor 108 may be connected to measure the vibration frequency of the fore line 105 or vacuum pump 106, instead of or in addition to the chamber 104. A correlation between the vibration frequency and the pump speed can be found to determine whether the pump speed should be increased or decreased based on a comparison between the measured vibration frequency and a predetermined value. The comparison can be carried out by the controller 110 comparing a signal indicating the measured value from the sensor 108 to the predetermined value. The speed of vacuum pump 106 can be adjusted based on the comparison until the vibration frequency falls in an acceptable range.

Conventionally, during a pumping down operation of load lock chamber, vacuum pumps are often over-specified in order to rapidly bring the pressure in a load lock chamber to the target level. However, such method has the drawback of high power consumption and may cause a rather high level of dust remaining in the chamber. In some embodiments of the invention, the apparatus 100 can be used to manage the down time of a load lock pump in order to achieve an optimal or desired dust level in a load lock chamber with a minimal or lowered power consumption of the pump. For example, the chamber 104 can be a load lock chamber with a target pressure level preset for its pumping down operation as semiconductor wafers are being loaded into the chamber. In the first down cycle, the time spent for the vacuum pump 106 to bring the pressure level in the chamber 104 down to the target level is measured. At the end of or during the pumping down operation, the dust level in the chamber 104 is also measured. The pump speed is then adjusted up or down by a predetermined value in the next cycle. The time spent in the cycle for the vacuum pump 106 to bring the pressure in the chamber 104 to the target level, and the dust level in the chamber are measured again. Those measurements are analyzed to derive a correlation between the pump speed and the dust level. The process is then repeated until an optimal or desired operational goal is reached. As a result, this can lead to an optimal or desired dust level with minimum or lowered power consumption of the vacuum pump 106.

In some embodiments of the invention, the sensor 108 and controller 110 can be two separate devices. In some embodiments of the invention, the sensor 108 and controller 110 can be integrated as a single device. In some embodiments of the invention, the controller 110 can be built on the vacuum pump 106 as a single piece of equipment. In some embodiments of the invention, the number of sensor can be more than one, and the number of controller can also be more than one. In some embodiments of the invention, the apparatus 100 can have more than one vacuum pump acting in parallel or in series as sequential stages. In such case, the design of the sensor 108 and controller 110 may need to be modified in accommodation of the vacuum pump arrangement. It is understood that such modification can be readily carried out by a person skilled in the art without undue experimentation in light of this disclosure.

Figure 2:
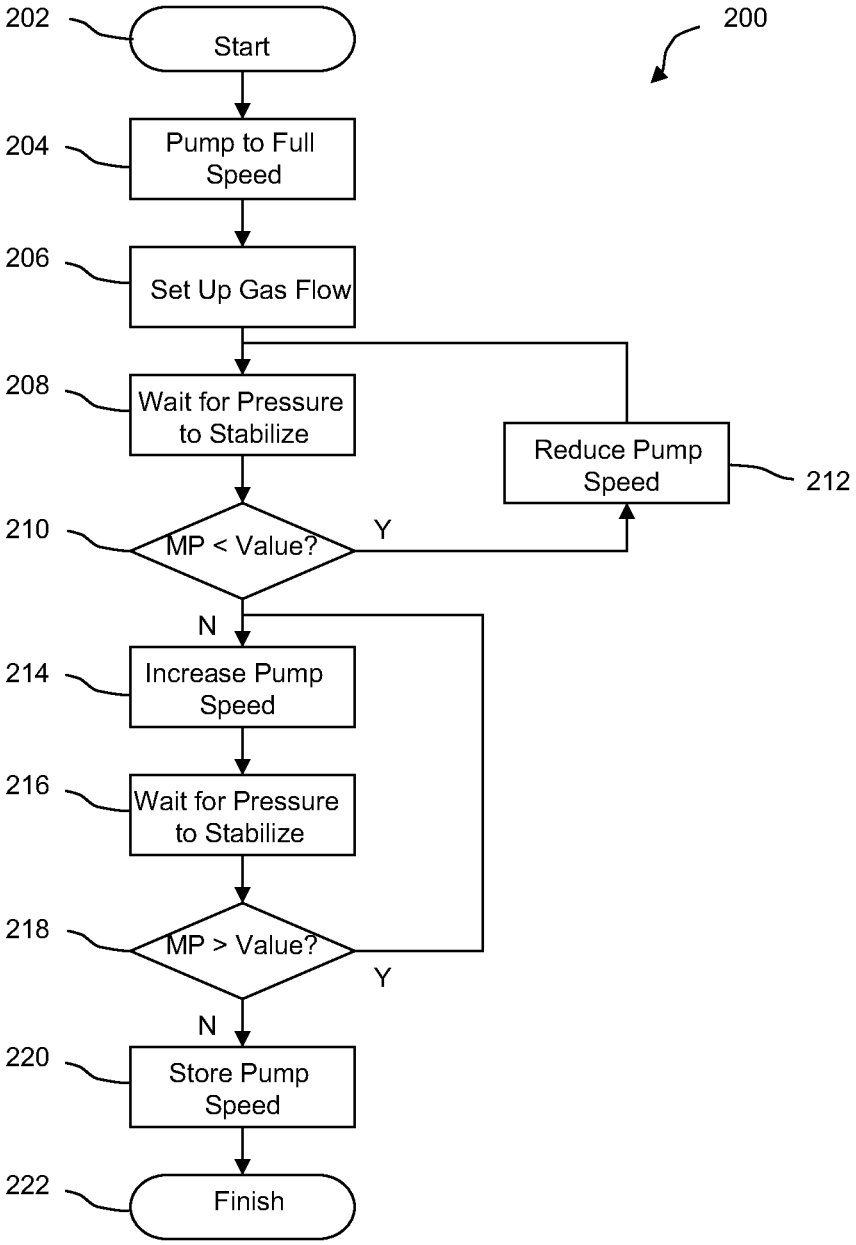
FIG. 2 illustrates a flowchart showing a method for tuning pump speed in accordance with some embodiments of the invention.

FIG. 2 illustrates a flowchart 200 showing a method for tuning pump speed in accordance with embodiments of the invention. The process flow starts at step 202. Referring also to FIG. 1, at step 204, the vacuum pump 106 is turned on to the full speed. At step 206, gas flows from the gas supply 102 to the chamber 104 are set up to desired process conditions. At step, 208, the process waits until the pressure of the gas in the chamber 104 stabilizes. At step 210, the measured pressure of the gas in the chamber 104 is compared to a predetermined value representing an optimal or desired pressure level. If the measured pressure is lower than the predetermined value, the pump speed is reduced by a predetermined decrement at step 212. If the measured pressure is higher than the predetermined value, the pump speed in increased by a predetermined increment at step 214. Then, the process waits until the pressure of the gas in the chamber 104 stabilizes at step 216. At step 218, the measured pressure of the gas in the chamber 104 is again compared to the predetermined value. If the measured pressure is still higher than the predetermined value, the pump speed is again increased by a predetermined increment at step 214 and the step 216 is repeated. If the measured pressure is lower than the predetermined value, the pump speed is stored at the step 220, and the process finishes at step 222. It is understood that the process flow as illustrated in FIG. 2 can be implemented as control logic in the controller 110.

In some embodiments of the invention, the process flow as illustrated by FIG. 2 can be used for adjusting the rotational speed of load lock pump. In some embodiments of the invention, the process flow as illustrated by FIG. 2 can be used to avoid undesired vibration in the vacuum pump 106, fore line 105 and chamber 104 with few modifications. For example, the measured pressure used in the process flow can be changed to measured vibration frequency of the vacuum pump 106, fore line 105 or chamber 104. It is understood that such modifications are rather technical, and do not deviate from the scope and spirit of the invention.

One advantage of the invention is the conservation of energy realized by the disclosed apparatus and method capable of operating vacuum pumps at optimal speeds. It maintains the simplicity in designing vacuum pumps that might be a little over-specified in order to accommodate various pipe work geometries in different foundries, while enabling vacuum pumps to consume less energy than they otherwise would. The automated pump speed tuning apparatus and method are able to reach the optimal speed faster and in a much more accurate manner than the conventional manual method. This also eliminates room for human errors resulted from manually adjusting the pump speed under stressful conditions.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A method for tuning a speed of a vacuum pump connected to a chamber, comprising:

setting the vacuum pump at a first speed;

measuring a characteristic of a gas in the chamber;

comparing the measured characteristic to a predetermined value; and adjusting the speed of the vacuum pump based on the comparison between the measured characteristic and the predetermined value such that when the speed of the vacuum pump is decreased it is decreased by a decrement amount and when the speed of the vacuum pump is increased it is increased by an increment amount wherein the decrement amount is larger than the increment amount.

2. The method of claim 1 wherein the characteristic is a pressure of the gas in the chamber.

3. The method of claim 1 wherein the decrement amount is about five times the increment amount.

4. The method of claim 1, before the step of adjusting, further comprising waiting for the speed of the vacuum pump to stabilize.

5. The method of claim 1 wherein the characteristic comprises a vibration frequency of the chamber.

6. The method of claim 5 wherein the step of adjusting comprises reducing or increasing the speed of the vacuum pump until the vibration frequency of the chamber falls in a predetermined range.

7. The method of claim 1 wherein the characteristic comprises a time spent for bringing pressure in the chamber to a target level.

8. The method of claim 7 wherein the characteristic comprises a dust level in the chamber.

9. The method of claim 8 further comprising analyzing a correlation between the time and the dust level for adjusting the speed of the vacuum pump.

* * * * *